US010960527B2

(12) United States Patent
Thorson et al.

(10) Patent No.: US 10,960,527 B2
(45) Date of Patent: Mar. 30, 2021

(54) BIT RETENTION ASSEMBLY FOR ROTARY HAMMER

(71) Applicant: MILWAUKEE ELECTRIC TOOL CORPORATION, Brookfield, WI (US)

(72) Inventors: Troy C. Thorson, Cedarburg, WI (US); Jeremy R. Ebner, Milwaukee, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 281 days.

(21) Appl. No.: 15/606,422

(22) Filed: May 26, 2017

(65) Prior Publication Data

US 2017/0282345 A1 Oct. 5, 2017

Related U.S. Application Data

(63) Continuation of application No. 13/763,923, filed on Feb. 11, 2013, now Pat. No. 9,662,778.

(60) Provisional application No. 61/597,542, filed on Feb. 10, 2012.

(51) Int. Cl.
*B25D 17/24* (2006.01)
*B25D 17/08* (2006.01)

(52) U.S. Cl.
CPC ..... *B25D 17/084* (2013.01); *B25D 17/088* (2013.01); *B25D 17/24* (2013.01); *B25D 2217/0049* (2013.01); *B25D 2250/345* (2013.01)

(58) Field of Classification Search
CPC ..... B25D 17/084; B25D 17/088; B25D 17/24
USPC ..... 173/20
See application file for complete search history.

(56) References Cited

U.S. PATENT DOCUMENTS

| | | | | |
|---|---|---|---|---|
| 2,913,263 | A | 11/1959 | Zajac | |
| 3,685,594 | A * | 8/1972 | Koehler | B25D 11/108 173/48 |
| 4,174,113 | A | 11/1979 | Eckman | |
| 4,378,053 | A | 3/1983 | Simpson | |
| 4,701,083 | A | 10/1987 | Deutschenbaur | |
| 4,858,939 | A | 8/1989 | Riggs | |
| 5,000,631 | A | 3/1991 | Deutschenbaur | |
| 5,558,478 | A | 9/1996 | Odendahl | |
| 5,709,393 | A | 1/1998 | Von Keudell | |
| 5,954,347 | A | 9/1999 | Buck | |
| 5,971,403 | A | 10/1999 | Yahagi | |
| 6,053,675 | A | 4/2000 | Holland | |
| 6,135,461 | A | 10/2000 | Below | |
| 6,241,026 | B1 * | 6/2001 | Wache | B23Q 3/12 173/132 |
| 6,461,089 | B2 | 2/2002 | Adrian | |
| 6,497,418 | B2 | 12/2002 | Yahagi | |
| 6,659,473 | B2 | 1/2003 | Below | |
| 6,543,789 | B2 | 4/2003 | Frenzel | |

(Continued)

*Primary Examiner* — Anna K Kinsaul
*Assistant Examiner* — Chinyere J Rushing-Tucker
(74) *Attorney, Agent, or Firm* — Michael Best & Friedrich LLP

(57) ABSTRACT

A rotary hammer includes a motor, a spindle coupled to the motor for receiving torque from the motor, a piston at least partially received within the spindle for reciprocation therein, and an anvil received within the spindle for reciprocation in response to reciprocation of the piston. The anvil imparts axial impacts to a tool bit in response to reciprocation of the piston. The rotary hammer also includes a bit retention assembly for securing the tool bit to the spindle.

19 Claims, 10 Drawing Sheets

(56) References Cited

U.S. PATENT DOCUMENTS

| | | | | |
|---|---|---|---|---|
| 6,669,206 | B2 | 12/2003 | Hanke | |
| 6,745,850 | B2 | 6/2004 | Hahn | |
| 6,834,864 | B2 | 12/2004 | Girardeau | |
| 6,929,266 | B2 | 8/2005 | Peters | |
| 6,932,358 | B1 | 8/2005 | Geisman | |
| 7,086,813 | B1 | 8/2006 | Boyle | |
| 7,284,622 | B2 | 10/2007 | Hahn | |
| 7,338,051 | B2 | 3/2008 | Buchholz | |
| 7,481,608 | B2 | 1/2009 | Zhou | |
| 7,661,484 | B2 | 2/2010 | Berger | |
| 7,712,746 | B2 | 5/2010 | Manschitz | |
| 8,376,671 | B2 | 2/2013 | Kaneko | |
| 8,714,566 | B2 | 5/2014 | Campbell | |
| 2003/0047887 | A1* | 3/2003 | Hahn | B25D 17/088 279/19.1 |
| 2003/0047888 | A1* | 3/2003 | Hahn | B25D 17/088 279/19.1 |
| 2003/0083186 | A1 | 5/2003 | Hetcher | |
| 2003/0137114 | A1 | 7/2003 | Baumann | |
| 2004/0166730 | A1 | 8/2004 | Wascow | |
| 2005/0016745 | A1 | 1/2005 | Hahn | |
| 2006/0232024 | A1 | 10/2006 | Chu | |
| 2008/0006418 | A1 | 1/2008 | Berghauser | |
| 2008/0100006 | A1 | 5/2008 | Chu | |
| 2008/0184852 | A1 | 8/2008 | Peters | |
| 2008/0302549 | A1 | 12/2008 | Zeiler | |
| 2010/0176561 | A1 | 7/2010 | Braun | |
| 2010/0282485 | A1 | 11/2010 | Puzio | |
| 2011/0073338 | A1* | 3/2011 | Ikuta | B25D 17/24 173/162.2 |

* cited by examiner

BIT RETENTION ASSEMBLY FOR ROTARY HAMMER

CROSS-REFERENCE TO RELATED APPLICATIONS

This application is a continuation of co-pending U.S. patent application Ser. No. 13/763,923 filed Feb. 11, 2013, now U.S. Pat. No. 9,662,778, which claims priority to U.S. Provisional Patent Application No. 61/597,542 filed Feb. 10, 2012, the entire contents of each of which is incorporated herein by reference.

FIELD OF THE INVENTION

The present invention relates to rotary power tools, and more particularly to bit retention assemblies for rotary power tools.

BACKGROUND OF THE INVENTION

Rotary hammers typically include a rotatable spindle, a reciprocating piston within the spindle, and a striker that is selectively reciprocable within the piston in response to an air pocket developed between the piston and the striker. Rotary hammers also typically include an anvil that is impacted by the striker when the striker reciprocates within the piston. The impact between the striker and the anvil is transferred to a tool bit, causing it to reciprocate for performing work on a work piece. Rotary hammers further include bit retention assemblies for securing a tool bit within the spindle.

SUMMARY OF THE INVENTION

The invention provides, in one aspect, a rotary hammer adapted to impart axial impacts to a tool bit. The rotary hammer includes a motor, a spindle coupled to the motor for receiving torque from the motor, a piston at least partially received within the spindle for reciprocation therein, and an anvil received within the spindle for reciprocation in response to reciprocation of the piston. The anvil imparts axial impacts to the tool bit in response to reciprocation of the piston. The rotary hammer also includes a bit retention assembly for securing the tool bit to the spindle. The bit retention assembly includes a resilient member surrounding the spindle and positioned between a first washer and a second washer, a sleeve at least partially surrounding the spindle, the sleeve abutting the second washer, a latch receivable within a slot formed in the spindle to be engageable with the tool bit, the latch is slidably biased into engagement with the tool bit, and a collar moveable relative to the spindle between a first position and a second position. The first position of the collar secures the tool bit to the spindle and the second position of the collar allows the tool bit to be removed from the spindle. In response to the anvil transitioning from an impact mode to an idle mode in which the anvil is brought to rest in the spindle, the anvil imparts a final axial impact on the tool bit, moving the latch, the sleeve, and the second washer toward the resilient member, thereby compressing the resilient member against the first washer.

The invention provides, in one aspect, a rotary hammer adapted to impart axial impacts to a tool bit. The rotary hammer includes a motor, a spindle coupled to the motor for receiving torque from the motor, a piston at least partially received within the spindle for reciprocation therein, and an anvil received within the spindle for reciprocation in response to reciprocation of the piston. The anvil imparts axial impacts to the tool bit in response to reciprocation of the piston. The rotary hammer also includes a bit retention assembly for securing the tool bit to the spindle. The bit retention assembly includes a resilient member surrounding the spindle and positioned between a first washer and a second washer, a sleeve at least partially surrounding the spindle, the sleeve abutting the second washer, a dust shield coupled to the spindle for co-rotation therewith in front of the first washer, a front collar trapped between the second washer and the dust shield, a latch receivable within a slot formed in the spindle to be engageable with the tool bit, the latch is slidably biased into engagement with the tool bit, and a rear collar moveable relative to the spindle between a first position and a second position. The first position of the rear collar secures the tool bit to the spindle and the second position of the rear collar allows the tool bit to be removed from the spindle. In response to the anvil transitioning from an impact mode to an idle mode in which the anvil is brought to rest in the spindle, the anvil imparts a final axial impact on the tool bit, moving the latch, the sleeve, and the second washer toward the resilient member, thereby compressing the resilient member against the first washer.

The invention provides, in one aspect, a rotary hammer adapted to impart axial impacts to a tool bit. The rotary hammer includes a motor, a spindle coupled to the motor for receiving torque from the motor, a piston at least partially received within the spindle for reciprocation therein, and an anvil received within the spindle for reciprocation in response to reciprocation of the piston. The anvil imparts axial impacts to the tool bit in response to reciprocation of the piston. The rotary hammer also includes a bit retention assembly for securing the tool bit to the spindle. The bit retention assembly includes adjacent first and second O-rings surrounding the spindle and positioned between a first washer and a second washer, a sleeve at least partially surrounding the spindle, the sleeve abutting the second washer, a dust shield coupled to the spindle for co-rotation therewith in front of the first washer, a front collar trapped between the second washer and the dust shield, a lock ring axially secured to the spindle, the first washer being abutted with the lock ring and prevented from forward movement on the spindle beyond the lock ring, a latch receivable within a slot formed in the spindle to be engageable with the tool bit, the latch is slidably biased into engagement with the tool bit, and a rear collar moveable relative to the spindle between a first position and a second position. The first position of the rear collar secures the tool bit to the spindle and the second position of the rear collar allows the tool bit to be removed from the spindle. In response to the anvil transitioning from an impact mode to an idle mode in which the anvil is brought to rest in the spindle, the anvil imparts a final axial impact on the tool bit, moving the latch, the sleeve, and the second washer toward the O-rings, thereby compressing the O-rings against the first washer. Substantially no relative movement occurs between the latch, the sleeve, and the rear collar while the first and second O-rings cushion the final impact on the tool bit, thereby reducing any reaction forces exerted on the latch.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
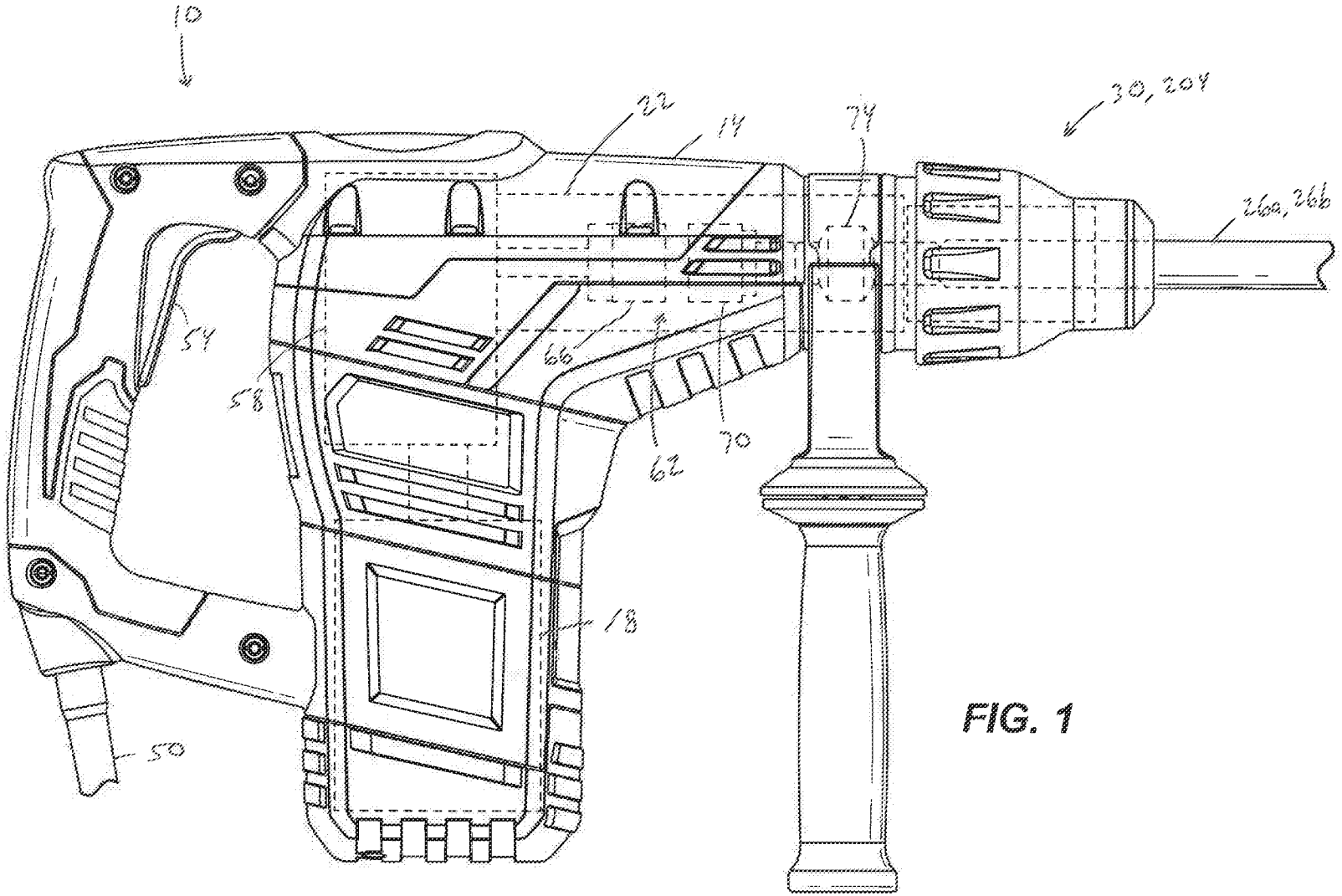
FIG. 1 is a side view of a rotary hammer of the invention.

FIG. 1 illustrates a rotary hammer 10 including a housing 14, a motor 18 disposed within the housing 14, and a rotatable spindle 22 coupled to the motor 18 for receiving torque from the motor 18. A tool bit 26*a*, 26*b* may be secured to the spindle 22 for co-rotation with the spindle 22 (e.g., using a spline-fit or a hexagonal-fit). As is described in more detail below, the rotary hammer 10 also includes a bit retention assembly 30 coupled for co-rotation with the spindle 22 to facilitate quick removal and replacement of different tool bits 26*a*, 26*b*. When a tool bit 26*a* having a splines 34 is inserted within the spindle 22 for co-rotation therewith, a necked section or groove 38 (FIG. 2) around the periphery of the tool bit shank is engaged by the bit retention assembly 30 to axially retain the tool bit 26*a* to the spindle 22. Alternatively, when a tool bit 26*b* having a hexagonal outer periphery 42 is inserted within the spindle 22 for co-rotation therewith, a single cut or recessed flat 46 (FIG. 4) coinciding with one of the surfaces of the hexagonal tool bit shank is engaged by the bit retention assembly 30 to axially retain the tool bit 26*b* to the spindle 22. With both tool bits 26*a*, 26*b*, the bit retention assembly 30 constrains axial movement of the tool bits 26*a*, 26*b* relative to the spindle 22 to the lengths of the groove 38 and the recessed flat 46, respectively.

With reference to FIG. 1, the motor 18 is powered by a remote power source (e.g., a household electrical outlet) through a power cord 50. Alternatively, the motor 18 may be configured as a DC motor that receives power from an on-board power source (e.g., a battery). The battery may include any of a number of different nominal voltages (e.g., 12V, 18V, etc.), and may be configured having any of a number of different chemistries (e.g., lithium-ion, nickel-cadmium, etc.). The motor 18 is selectively activated by depressing a trigger 54 which, in turn, actuates a switch (not shown). The switch may be electrically connected to the motor 18 via a top-level or master controller, or one or more circuits, for controlling operation of the motor 18.

With continued reference to FIG. 1, the rotary hammer 10 further includes a transmission 58 for transferring torque from the motor 18 to the spindle 22 and an impact mechanism 62 driven by the transmission 58 for delivering repeated impacts to the tool bit 26*a*, 26*b* for performing work on a workpiece. In the illustrated embodiment, the impact mechanism 62 includes a reciprocating piston 66 disposed within the spindle 22, a striker 70 that is selectively reciprocable within the spindle 22 in response to reciprocation of the piston 66, and an anvil 74 that is impacted by the striker 70 when the striker 70 reciprocates toward the tool bit 26*a*, 26*b*. More specifically, an air pocket is developed between the piston 66 and the striker 70 when the piston 66 reciprocates within the spindle 22, whereby expansion and contraction of the air pocket induces reciprocation of the striker 70. The impact between the striker 70 and the anvil 74 is then transferred to the tool bit 26*a*, 26*b*, causing it to reciprocate for performing work on the workpiece.

FIGS. 2-7 illustrate one embodiment of a bit retention assembly 30 for use with the rotary hammer 10 of FIG. 1. The bit retention assembly 10 includes a rear collar 78 that is axially displaceable along the spindle 22 against the bias of a spring 82 between a forward position (FIG. 2) and a rearward position (FIG. 3), and a cylindrical pin 86 that is maintained within a slot 90 formed in the spindle 22 (FIGS. 2-5). The slot 90 extends between an exterior of the spindle 22 and a receptacle 94 in which the tool bit 26*a*, 26*b* is inserted. The pin 86 is oriented transversely to the spindle 22 and maintained between two adjacent washers 98, 102. The pin 86 is also coupled to the collar 78 for axial displacement therewith, such that rearward movement of the pin 86 within the slot 90 (from the frame of reference of FIG. 2) also causes the collar 78 to move rearward with respect to the spindle 22. The pin 86 is biased within the slot 90 to the position shown in FIG. 2 by the spring 82 and the washer 98. In this position, the pin 86 at least partially protrudes into the receptacle 94 when the collar 78 is in its forward position shown in FIG. 2.

With continued reference to FIGS. 2-5, the bit retention assembly 30 also includes a retaining ring 106 and a front collar 110 coupled for co-rotation with the spindle 22 between which the remaining components of the bit retention assembly 30 are secured. The front collar 110 is positioned forward of the rear collar 78 for limiting axial movement of the rear collar 78 in a forward direction, and includes a circumferential lip 114 surrounding a front portion of the rear collar 78.

To properly or fully insert the splined tool bit 26*a* within the spindle 22, the tool bit 26*a* may be inserted within the spindle 22 without separately pushing the collar 78 against the bias of the spring 82, causing the rear of the tool bit 26*a* to engage the pin 86 and push it rearward against the bias of the spring 82. As the pin 86 and the collar 78 are pushed rearward by continued insertion of the tool bit 26*a*, the pin 86 is also displaced radially outward within the slot 90 (FIG. 3) until the pin 86 clears the end of the tool bit 26*a*. The pin 86 is then returned to the position shown in FIG. 2 by the spring 82 in response to the pin 86 clearing the end of the tool bit 26*a* and the splines 34, at which time the pin 86 protrudes into the receptacle 94 and is at least partially received in the groove 38. Thereafter, the tool bit 26*a* is axially retained within the spindle 22, with the pin 86 constraining the axial reciprocation or stroke of the tool bit 26*a* during operation of the rotary hammer 10 to the length of the groove 38. The hexagonal tool bit 26*b* may be properly or fully inserted within the spindle 22 in the same manner, but in addition the tool bit 26*b* must be properly angularly oriented relative to the spindle 22 such that the recessed flat 46 in the tool bit 26*b* is aligned with the pin 86.

Figure 3:
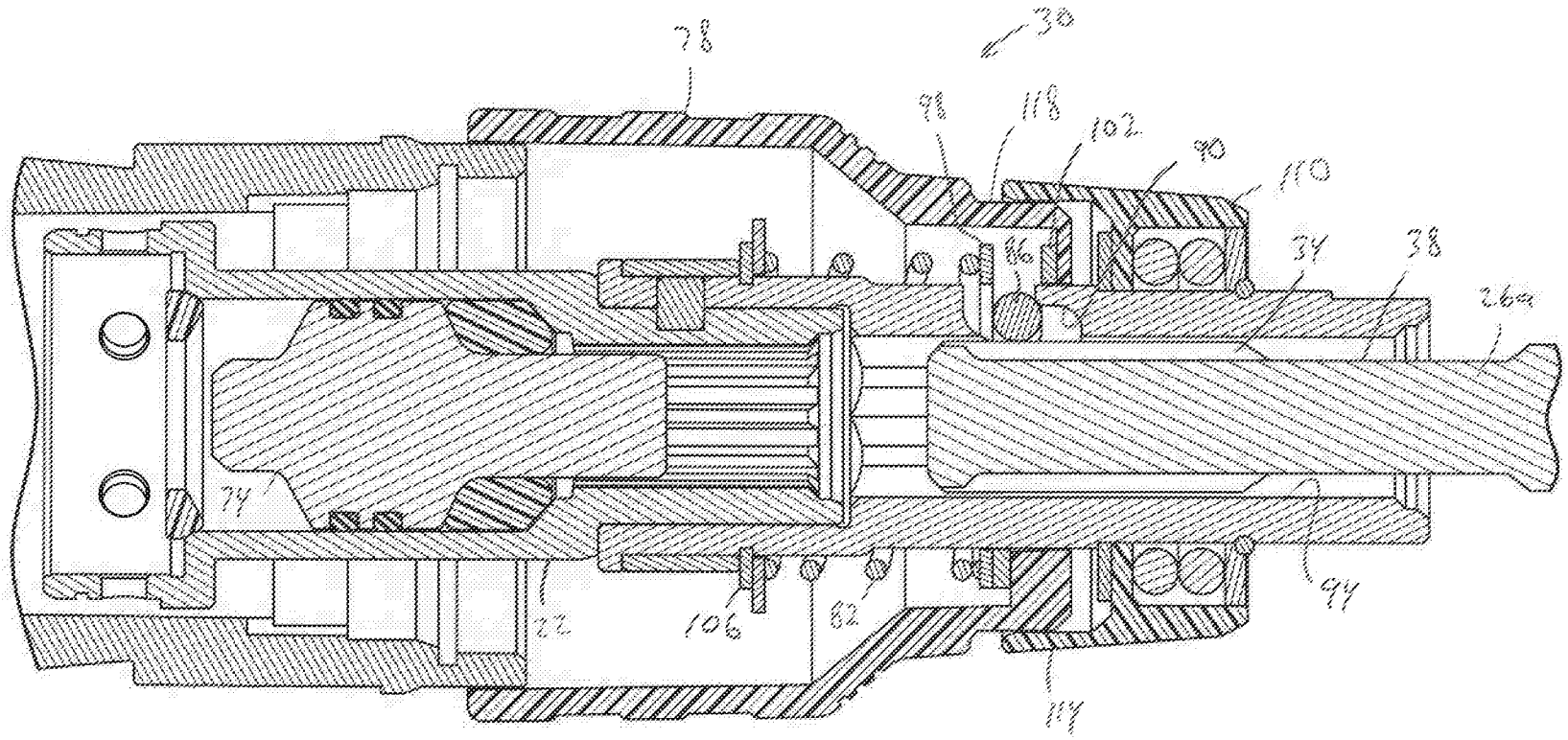
FIG. 3 is a cross-sectional view of the bit retention assembly of FIG. 2, illustrating the tool bit improperly inserted within the spindle.

To release either of the tool bits 26*a*, 26*b* from the bit retention assembly 30, the collar 78 is pushed against the bias of the spring 82 to the rearward position shown in FIG. 3, thereby moving with it the washers 98, 102 and the pin 86. The pin 86 is displaced within the slot 90 radially outwardly to a position in which it no longer protrudes into the receptacle 94, thereby allowing the end of the tool bit 26*a*, 26*b* to clear the pin 86 for removing the tool bit 26*a*, 26*b* from the spindle 22.

Figure 2:
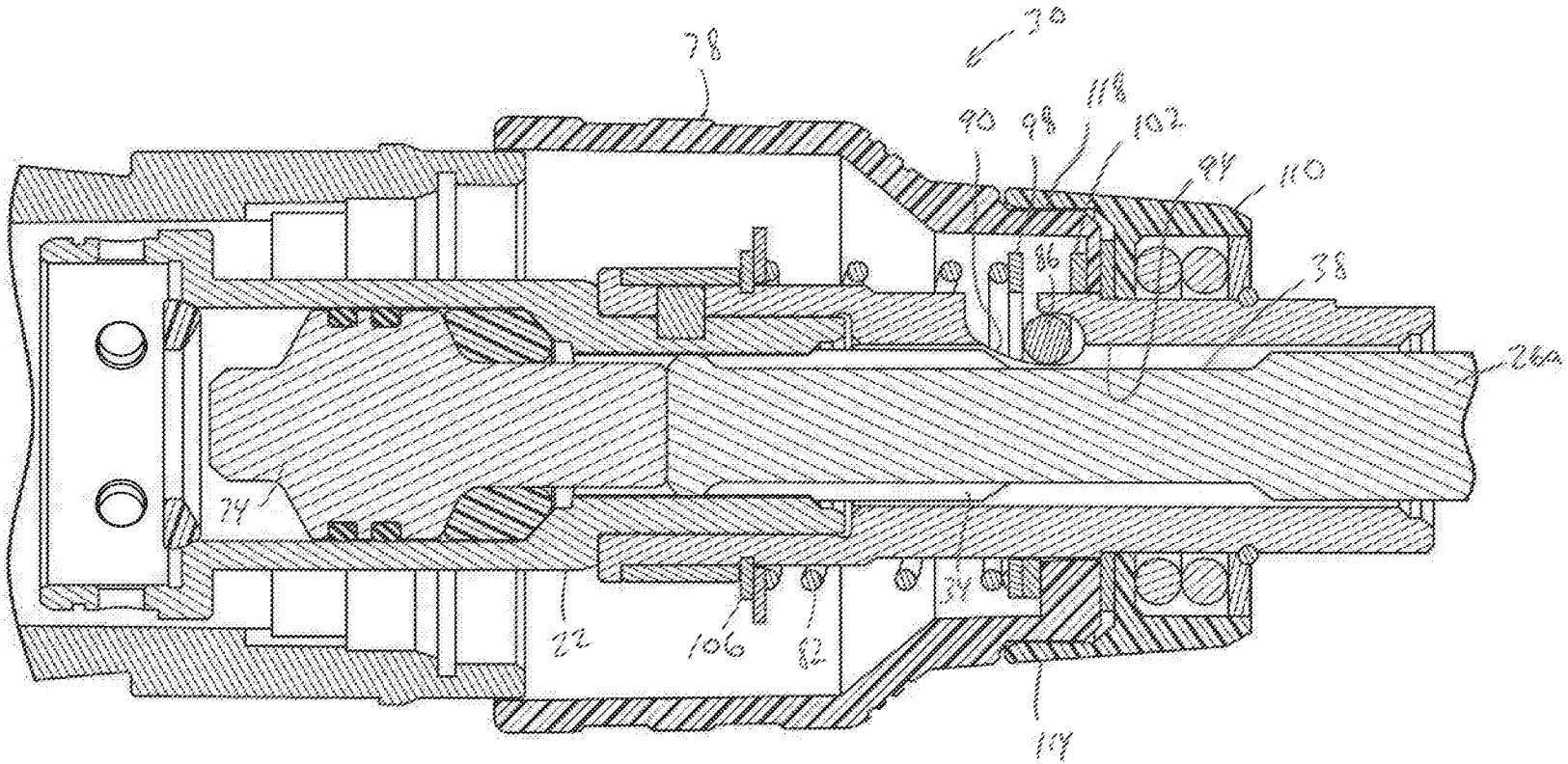
FIG. 2 is a cross-sectional view of one embodiment of a bit retention assembly for use with the rotary hammer of FIG. 1, illustrating a tool bit properly inserted within a spindle of the rotary hammer.
Figure 4:
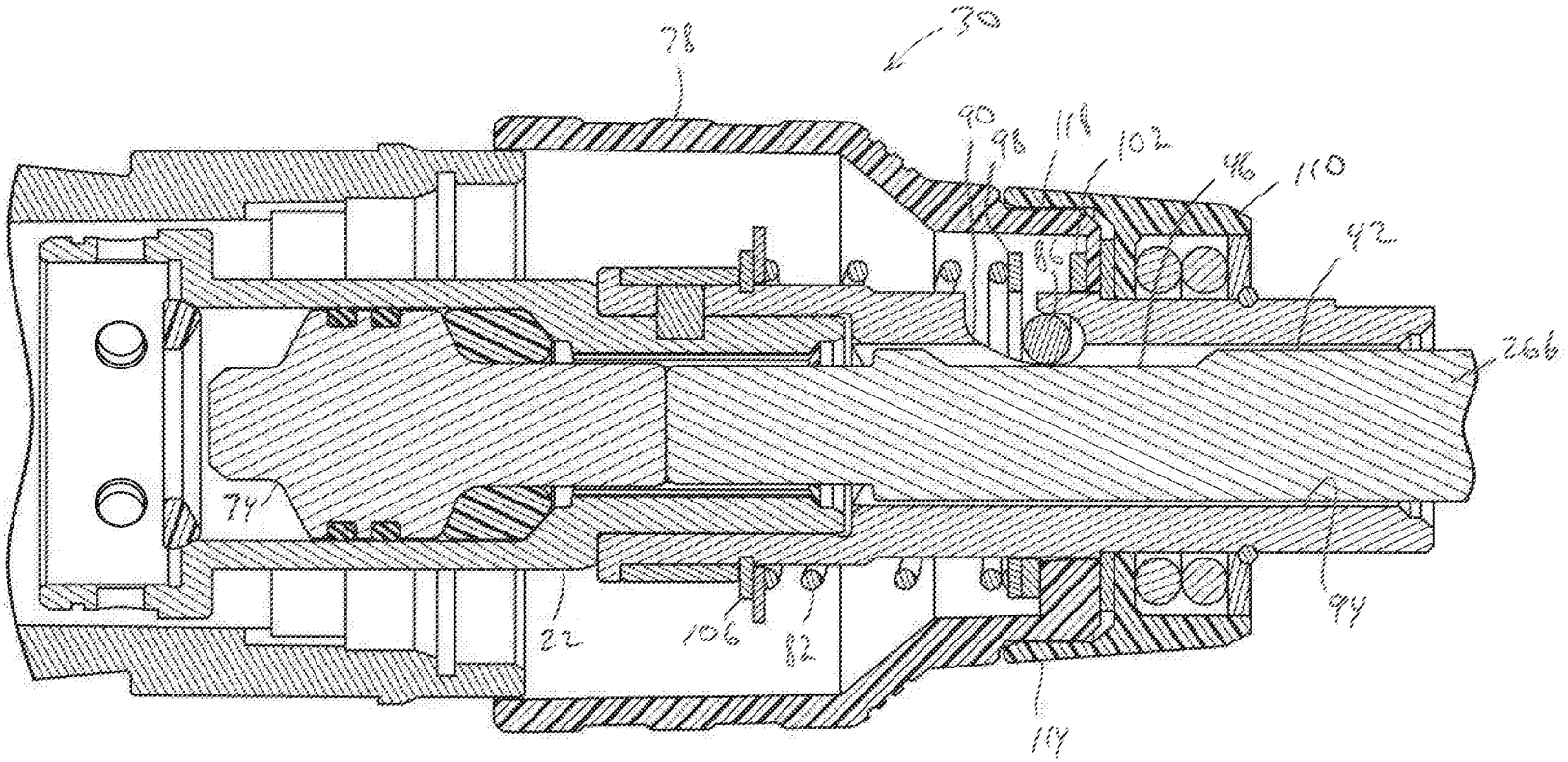
FIG. 4 is a cross-sectional view of the bit retention assembly of FIG. 2, illustrating a tool bit having a different configuration than that shown in FIG. 2 properly inserted within the spindle.
Figure 5:
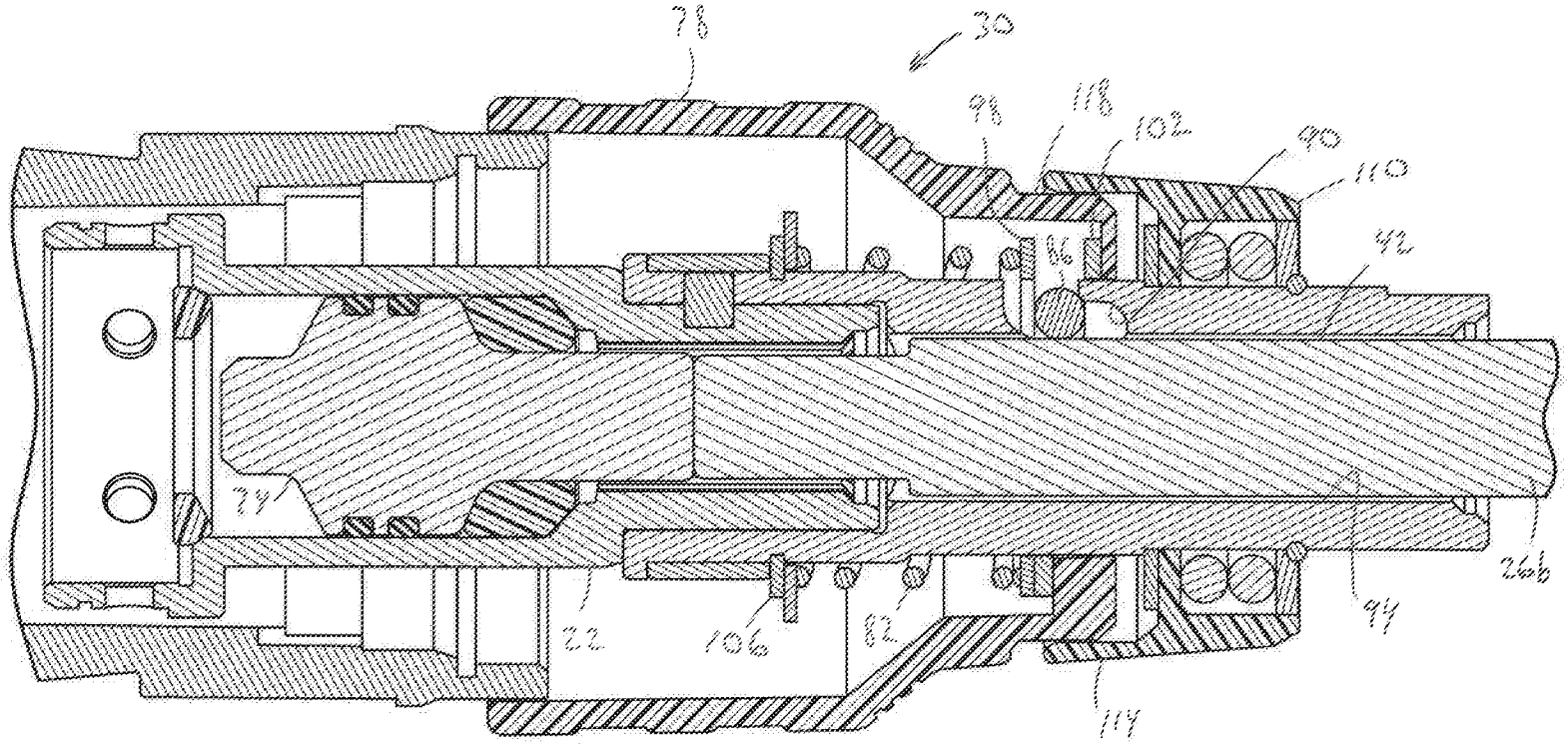
FIG. 5 is a cross-sectional view of the bit retention assembly of FIG. 2, illustrating the tool bit of FIG. 4 improperly inserted within the spindle.
Figure 6:
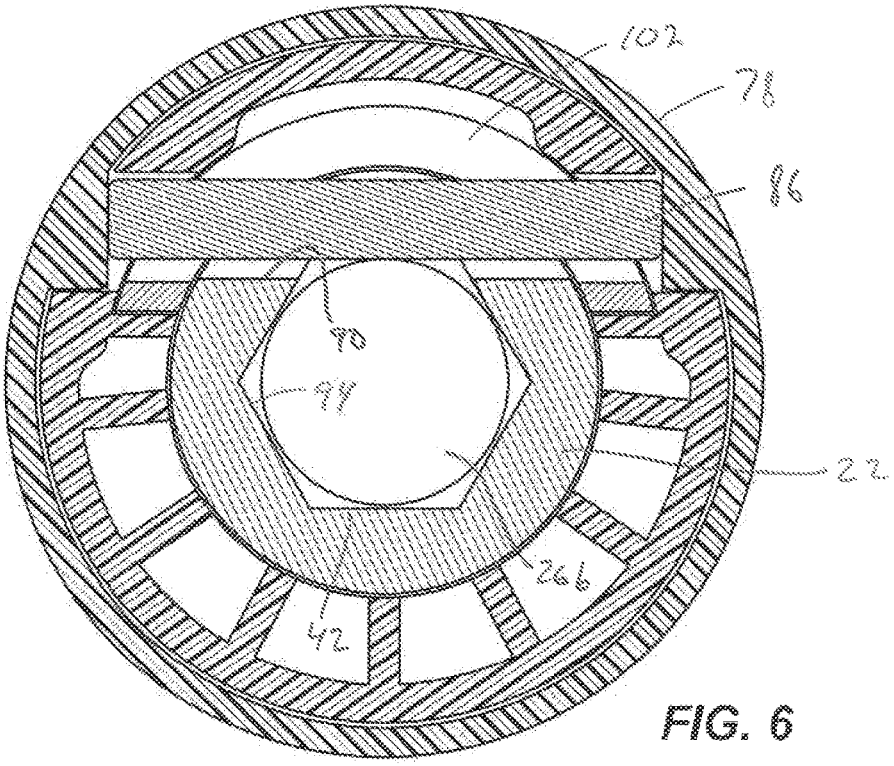
FIG. 6 is a cross-sectional view of the rotary hammer along line 6-6 in FIG. 5.
Figure 7:
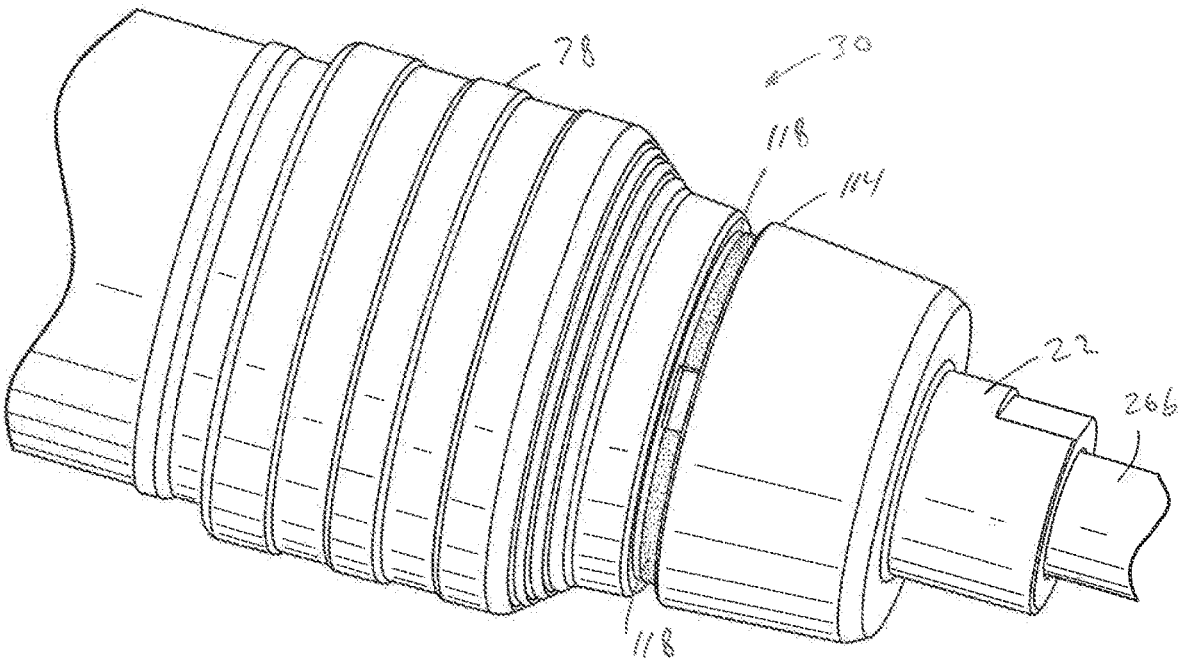
FIG. 7 is a perspective view of a collar of the bit retention assembly shown in a rearward position corresponding with the improper insertion of the tool bit within the spindle as shown in FIG. 5.

Should the splined tool bit 26*a* be inserted within the spindle 22 an insufficient amount (FIG. 3), or should the hexagonal tool bit 26*b* be inserted in an orientation in which the pin 86 is misaligned with the recessed flat 46 (FIG. 5), both of which instances being considered "improper" insertion of the tool bit 26*a*, 26*b* within the spindle 22, interference between the tool bit 26*a*, 26*b* and the pin 86 will inhibit the pin 86 from being returned to either of the positions shown in FIG. 2 or 4. Rather, the pin 86 would wedge within the slot 90 to prevent the collar 78 from returning to its normal operating or forward position shown in FIGS. 2 and 4. A front portion of the collar 78 includes an indicator 118 (e.g., a red stripe) on its outer peripheral surface (FIG. 7), which is exposed and visible to the user of the rotary hammer 10 when the collar 78 is maintained in its rearward position by the wedged pin 86, to indicate to the user the tool bit 26*a*, 26*b* is not fully secured by the bit retention assembly 30. The indicator 118 is otherwise covered or shrouded by the lip 114 of the front collar 110, and hidden from view of the user, when the tool bit 26*a*, 26*b* is fully and properly secured by the bit retention assembly 30 as shown in FIGS. 2 and 4.

Figure 8:
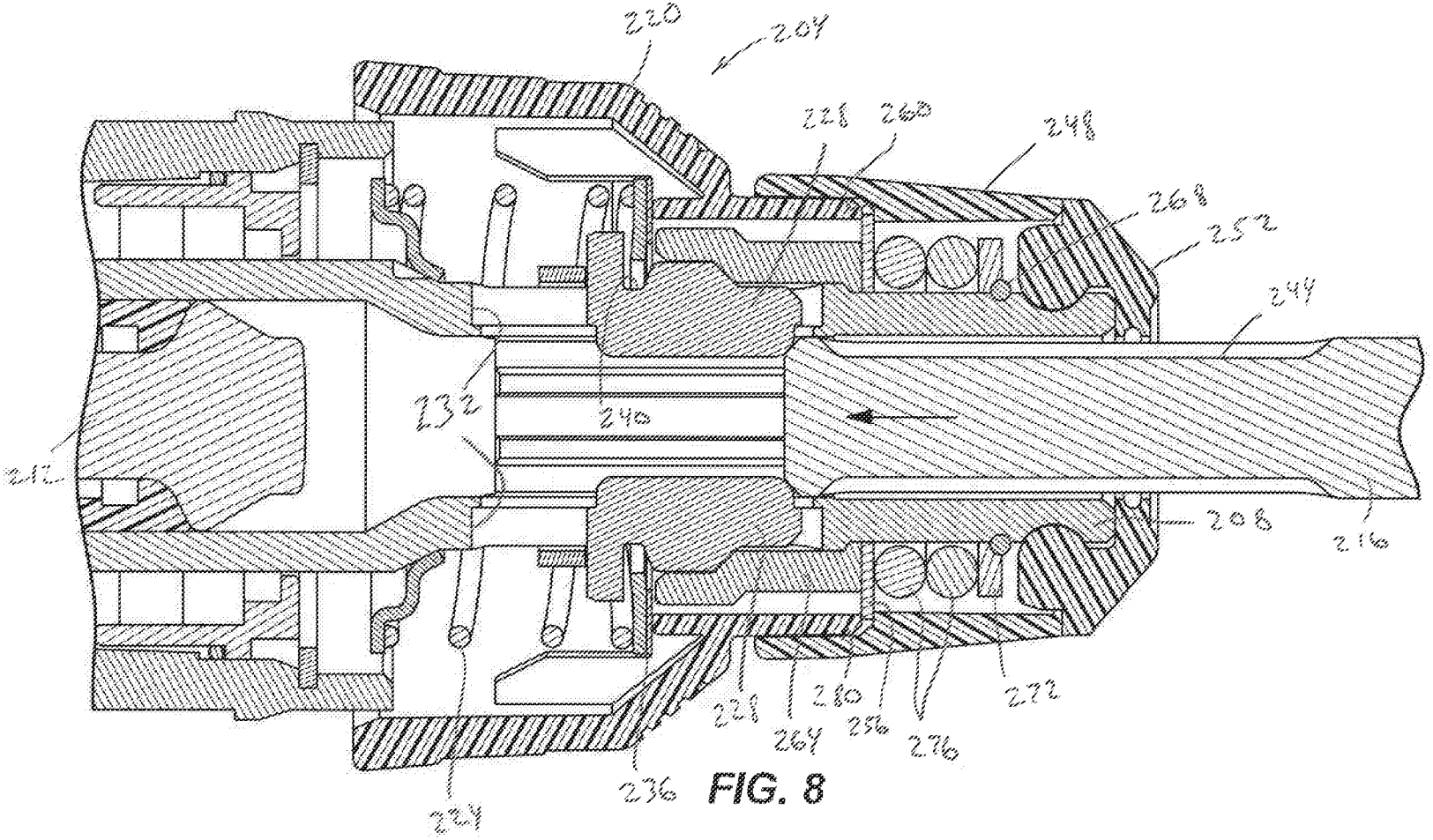
FIG. 8 is a cross-sectional view of another embodiment of a bit retention assembly for use with the rotary hammer of FIG. 1, illustrating a tool bit being inserted within a spindle of the rotary hammer.

FIGS. 8-11 illustrate another embodiment of a bit retention assembly 204 for use with the rotary hammer 10 of FIG. 1. With reference to FIG. 8, the hammer 10 includes a rotatable spindle 208 and an anvil 212 that is impacted by a reciprocating striker (FIG. 1). The impact between the striker and the anvil 212 is transferred to a splined tool bit 216, causing it to reciprocate for performing work on a workpiece. The bit retention assembly 204 includes a collar 220 that is axially displaceable along the spindle 208 against the bias of a spring 224 and opposed latches 228 that are displaceable within respective slots 232 in the spindle 208. The bit retention assembly 204 also includes a washer 236 positioned between the spring 224 and the collar 220. The inner portion of the washer 236 is also received within a recess 240 in the respective latches 228, such that displacement of the washer 236 results in displacement of the latches 228 within the slots 232.

The bit retention assembly 204 further includes a fixed or stationary front collar 248, a dust shield 252 adjacent a front edge of the front collar 248, and a washer 256 adjacent an annular step 260 on an internal periphery of the front collar 248 (FIGS. 8-11). The front collar 248 is trapped or held stationary in an axial direction relative to the spindle 208 by the dust shield 252 and the washer 256. The bit retention assembly 204 also includes an inner locking sleeve 264 surrounding at least a front portion of each of the slots 232. The sleeve 264 limits the radially outward extent to which each of the latches 228 may be displaced during insertion of the tool bit 216 (FIG. 9), described in more detail below. The bit retention assembly 204 further includes a lock ring 268 secured to the spindle 208, a washer 272 adjacent the lock ring 268, and two O-rings 276 positioned between the washers 260, 272. When installed, the O-rings 276 may be slightly compressed between the washers 260, 272 for exerting a biasing force against the washer 260 and the locking sleeve 264 for maintaining the locking sleeve 264 in the position shown in FIGS. 8-11.

Figure 9:
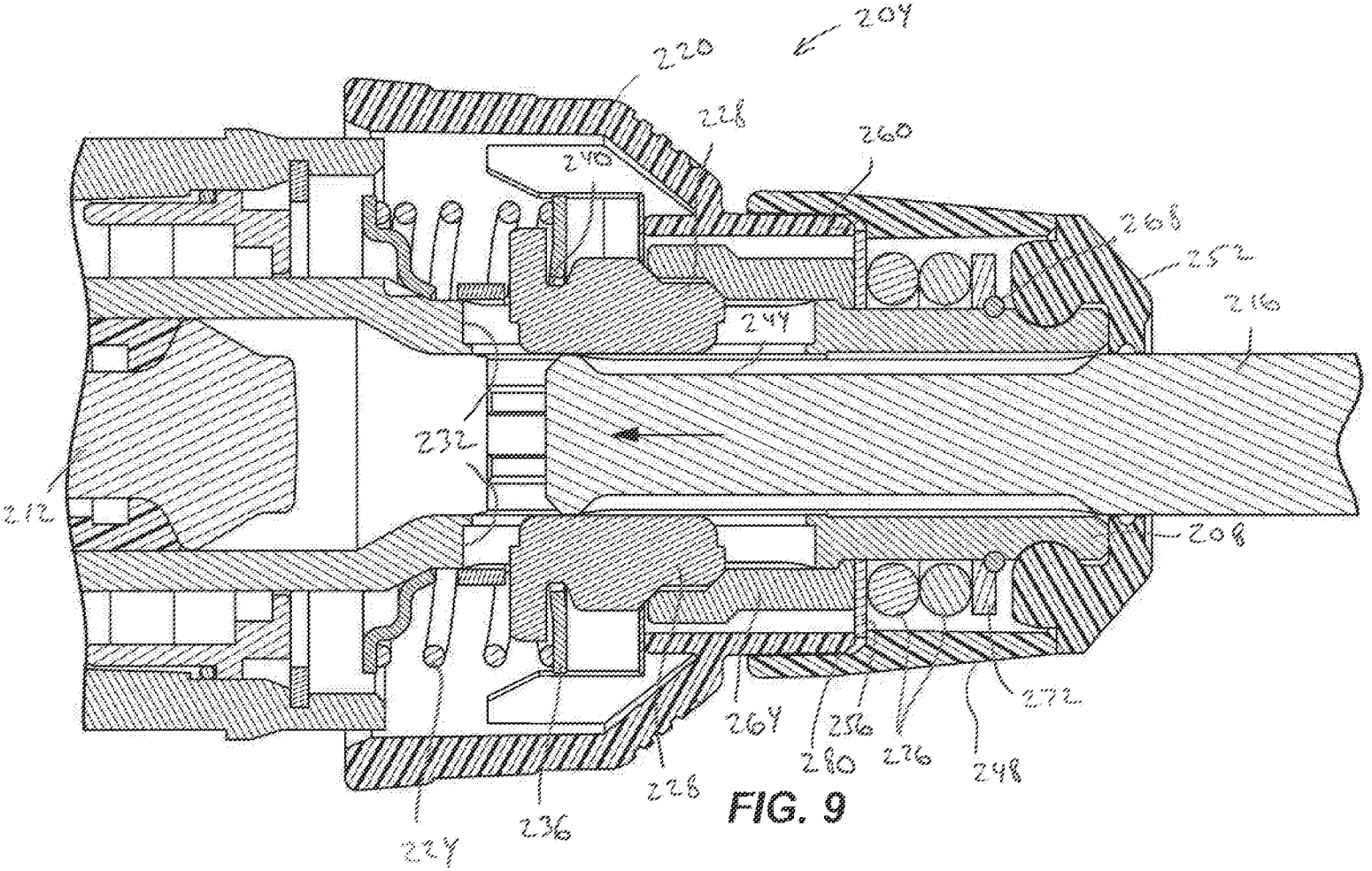
FIG. 9 is a cross-sectional view of the bit retention assembly of FIG. 8, illustrating continued insertion of the tool bit within the spindle.
Figure 10:
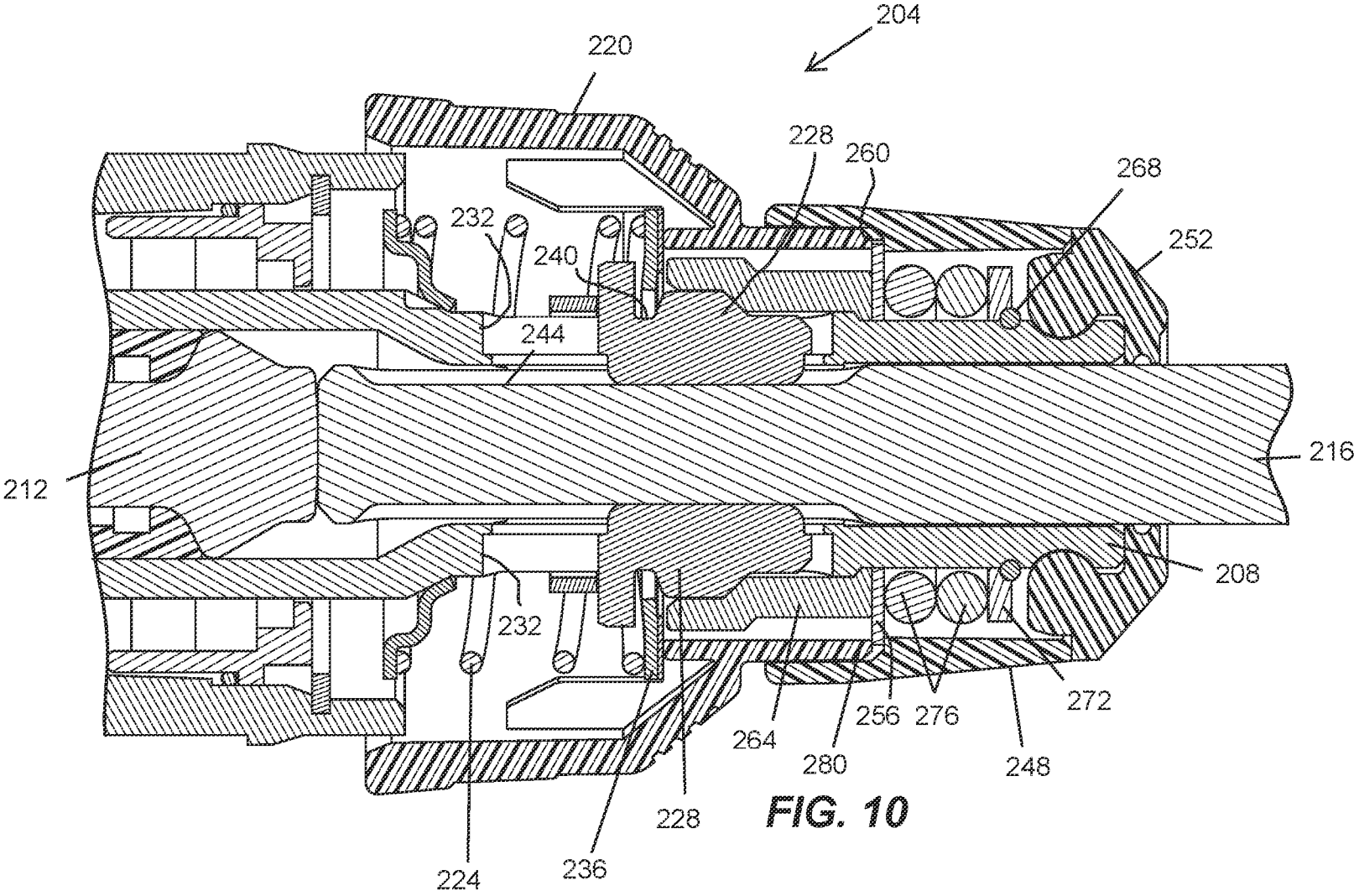
FIG. 10 is a cross-sectional view of the bit retention assembly of FIG. 8, illustrating the tool bit being fully inserted within the spindle.
Figure 11:
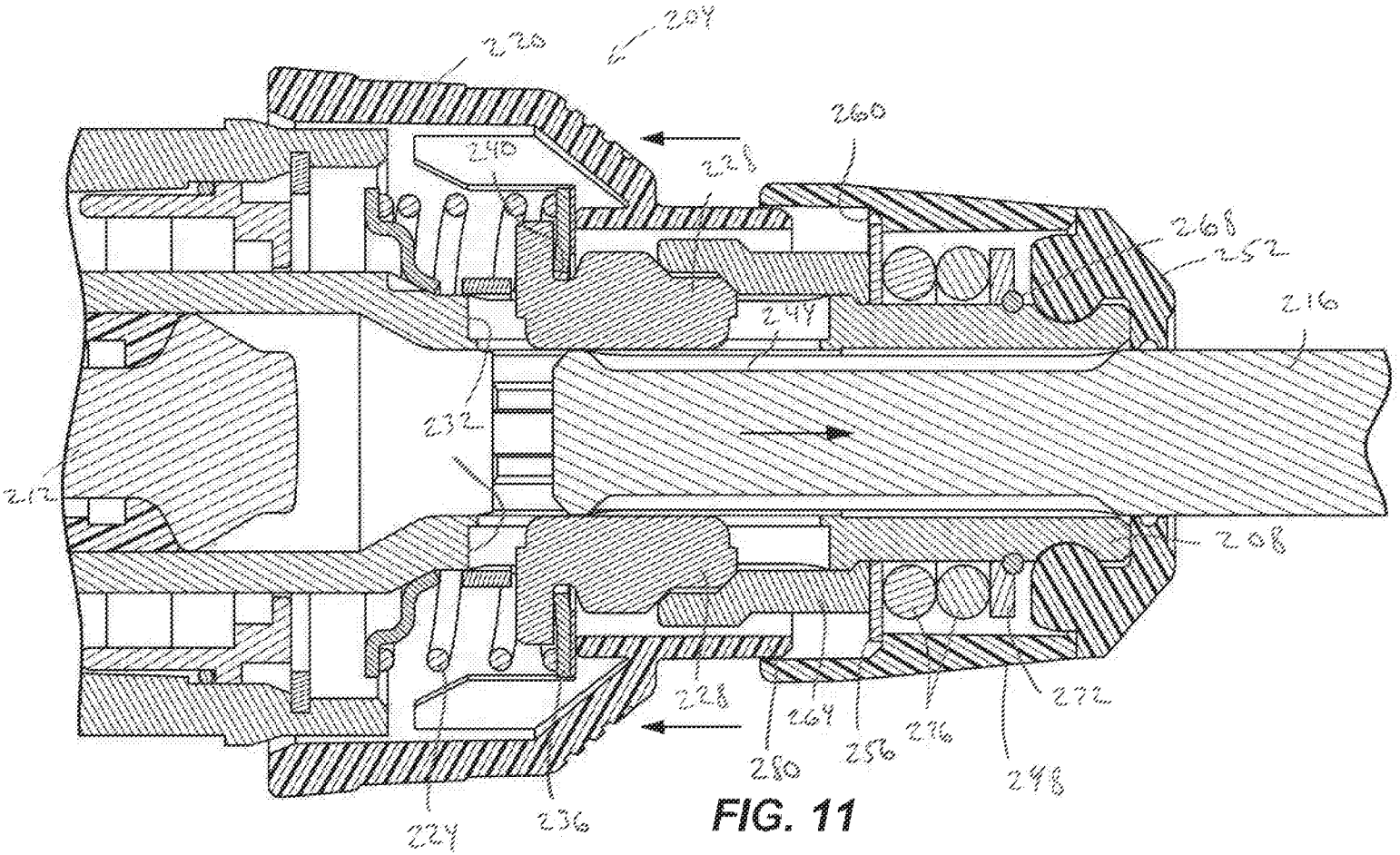
FIG. 11 is a cross-sectional view of the bit retention assembly of FIG. 8, illustrating a collar of the bit retention assembly being moved to a rearward position to permit removal of the tool bit from the spindle.

To secure the tool bit 216 within the bit retention assembly 204, the tool bit 216 is inserted within the spindle 208, causing the rear of the tool bit 216 to engage the latches 228 to push them rearward against the bias of the spring 224. As the latches 228 are pushed rearward by the tool bit 216, the latches 228 are also displaced radially outwardly within the respective slots 232 until the latches 228 clear the end of the tool bit 216 (FIG. 9). The latches 228 are returned to the position shown in FIG. 10 by the spring 224 and the washer 236 in response to the latches 228 clearing the end of the tool bit 216, at which time the latches 228 are at least partially received in corresponding grooves 244 of the tool bit 216 to define the extent to which the tool bit 216 may reciprocate within the spindle 208. To release the tool bit 216 from the bit retention assembly 204, the collar 220 is pushed rearward, thereby moving with it the washer 236 and the latches 228 against the bias of the spring 224 (FIG. 11). The latches 228 are displaced within the respective slots 232 radially outwardly to permit the end of the tool bit 216 to clear the latches 228, thereby allowing the tool bit 216 to be removed from the spindle 208.

When the rotary hammer with the bit retention assembly 204 transitions from an "impact" mode in which impacts from the anvil 212 are transferred to the tool bit 216, to an "idle" mode in which the anvil 212 is parked or brought to rest within the spindle 208, the bit 216 may exert a final impact on the latches 228 which, in turn, may be transferred to the locking sleeve 264. The impact on the locking sleeve 264 is cushioned by the O-rings 276, which are compressed slightly to permit the locking sleeve 264 to move forwardly with the latches 228 as the latches 228 and locking sleeve 264 decelerate. A front edge 280 of the rear collar 220 also contacts the washer 256. Therefore, as the O-rings 276 are compressed while absorbing the final impact on the tool bit 216, the rear collar 220 is also permitted to move forwardly a small amount with the latches 228 and the locking sleeve 264. As such, substantially no relative movement occurs between the latches 228, the locking sleeve 264, and the rear collar 220 while the O-rings 276 cushion the final impact on the tool bit 216, thereby reducing any reaction forces exerted on the latches 228 at this time. Alternatively, the O-rings 276 may have any of a number of different cross-sectional shapes, or may further be replaced by one or more compression springs.

Various features of the invention are set forth in the following claims.

What is claimed is:

1. A rotary hammer adapted to impart axial impacts to a tool bit, the rotary hammer comprising:

a motor;

a spindle coupled to the motor for receiving torque from the motor;

a piston at least partially received within the spindle for reciprocation therein;

an anvil received within the spindle for reciprocation in response to reciprocation of the piston, the anvil imparting axial impacts to the tool bit in response to reciprocation of the piston; and a bit retention assembly for securing the tool bit to the spindle, the bit retention assembly including a resilient member surrounding the spindle and positioned between a first washer and a second washer, the resilient member abutting the second washer, a sleeve at least partially surrounding the spindle, the sleeve abutting the second washer, a latch receivable within a slot formed in the spindle to be engageable with the tool bit, the latch is slidably biased into engagement with the tool bit, and a collar moveable relative to the spindle between a first position and a second position, the first position of the collar securing the tool bit to the spindle, the second position of the collar allowing the tool bit to be removed from the spindle;

wherein in response to the anvil transitioning from an impact mode to an idle mode in which the anvil is brought to rest in the spindle, the anvil imparts a final axial impact on the tool bit, moving the collar, the latch, the sleeve, and the second washer toward the resilient member, thereby compressing the resilient member against the first washer.

2. The rotary hammer of claim 1, wherein the collar is a rear collar, and wherein the bit retention assembly further includes a front collar positioned forward of the rear collar.

3. The rotary hammer of claim 2, wherein the bit retention assembly further comprises a dust shield coupled to the spindle for co-rotation therewith in front of the first washer.

4. The rotary hammer of claim 3, wherein the dust shield is axially retained to the spindle.

5. The rotary hammer of claim 4, wherein the front collar is trapped between the dust shield and the second washer.

6. The rotary hammer of claim 5, wherein the bit retention assembly further comprises a lock ring axially secured to the spindle, and wherein the first washer is abutted with the lock ring and prevented from forward movement on the spindle beyond the lock ring.

7. The rotary hammer of claim 6, wherein the resilient member is a first resilient member, and wherein the bit retention assembly includes a second resilient member surrounding the spindle and positioned between the first washer and the second washer.

8. The rotary hammer of claim 7, wherein the first resilient member is a first O-ring and the second resilient member is a second O-ring.

9. The rotary hammer of claim 1, wherein the latch is a first latch receivable within a first slot formed in the spindle, and wherein the bit retention assembly includes a second latch receivable within a second slot formed in the spindle to be engageable with the tool bit, and wherein the second latch is slidably biased into engagement with the tool bit.

10. A rotary hammer adapted to impart axial impacts to a tool bit, the rotary hammer comprising:

a motor;

a spindle coupled to the motor for receiving torque from the motor, the spindle including a receptacle configured to receive a portion of the tool bit;

a piston at least partially received within the spindle for reciprocation therein;

an anvil received within the spindle for reciprocation in response to reciprocation of the piston, the anvil imparting axial impacts to the tool bit in response to reciprocation of the piston; and a bit retention assembly for securing the tool bit to the spindle, the bit retention assembly including a resilient member surrounding the spindle and positioned between a first washer and a second washer, a sleeve at least partially surrounding the spindle, the sleeve abutting the second washer, a dust shield coupled to the spindle for co-rotation therewith in front of the first washer, a front collar trapped between the second washer and the dust shield, a latch receivable within a slot formed in the spindle to be engageable with the tool bit, the latch is slidably biased into engagement with the tool bit, and a rear collar operable to move the latch relative to the spindle from a first position to a second position, the first position of the latch securing the portion of the tool bit within the receptacle, the second position of the latch allowing the portion of the tool bit to be removed from the receptacle;

wherein in response to the anvil transitioning from an impact mode to an idle mode in which the anvil is brought to rest in the spindle, the anvil imparts a final axial impact on the tool bit, moving the latch, the sleeve, and the second washer toward the resilient member, thereby compressing the resilient member against the first washer.

11. The rotary hammer of claim 10, wherein the rear collar moves together with the latch and the sleeve as the second washer compresses the resilient member.

12. The rotary hammer of claim 10, wherein the second washer is in direct contact with the sleeve on a first side thereof, and wherein the second washer is in direct contact with the resilient member on a second side thereof.

13. The rotary hammer of claim 10, wherein the bit retention assembly further comprises a lock ring axially secured to the spindle, and wherein the first washer is abutted with the lock ring and prevented from forward movement on the spindle beyond the lock ring.

14. The rotary hammer of claim 13, wherein the resilient member is a first resilient member, and wherein the bit retention assembly includes a second resilient member surrounding the spindle and positioned between the first washer and the second washer.

15. The rotary hammer of claim 14, wherein the first resilient member is a first O-ring and the second resilient member is a second O-ring.

16. The rotary hammer of claim 10, wherein the rear collar, the latch, the sleeve, and the second washer move toward the resilient member in response to the anvil transitioning from the impact mode to the idle mode.

17. The rotary hammer of claim 10, wherein the rear collar is moved from the first position to the second position in a rearward direction away from the front collar.

18. The rotary hammer of claim 10, wherein the latch is a first latch receivable within a first slot formed in the spindle, and wherein the bit retention assembly includes a second latch receivable within a second slot formed in the spindle to be engageable with the tool bit, and wherein the second latch is slidably biased into engagement with the tool bit.

19. A rotary hammer adapted to impart axial impacts to a tool bit, the rotary hammer comprising:

a motor;

a spindle coupled to the motor for receiving torque from the motor;

a piston at least partially received within the spindle for reciprocation therein;

an anvil received within the spindle for reciprocation in response to reciprocation of the piston, the anvil imparting axial impacts to the tool bit in response to reciprocation of the piston; and a bit retention assembly for securing the tool bit to the spindle, the bit retention assembly including adjacent first and second O-rings surrounding the spindle and positioned between a first washer and a second washer, a sleeve at least partially surrounding the spindle, the sleeve abutting the second washer, a dust shield coupled to the spindle for co-rotation therewith in front of the first washer, a front collar trapped between the second washer and the dust shield, a lock ring axially secured to the spindle, the first washer being abutted with the lock ring and prevented from forward movement on the spindle beyond the lock ring, a latch receivable within a slot formed in the spindle to be engageable with the tool bit, the latch is slidably biased into engagement with the tool bit, and a rear collar moveable relative to the spindle between a first position and a second position, the first position of the rear collar securing the tool bit to the spindle, the second position of the rear collar allowing the tool bit to be removed from the spindle;

wherein in response to the anvil transitioning from an impact mode to an idle mode in which the anvil is brought to rest in the spindle, the anvil imparts a final axial impact on the tool bit, moving the rear collar, the latch, the sleeve, and the second washer toward the O-rings, thereby compressing the O-rings against the first washer.

* * * * *